United States Patent [19]

Nishimura et al.

[11] 4,360,130

[45] Nov. 23, 1982

[54] DISPENSER, PARTICULARLY FOR LIQUID SOAP

[75] Inventors: Haruo Nishimura, Suita; Masaaki Nakaya, Toyonaka; Katsuji Nakano, Suita; Noboru Matsuda, Joyo; Noriyuki Matsumoto, Toyonaka, all of Japan

[73] Assignees: Duskin Franchise Kabushiki Kaisha; Kabushiki Kaisha Sunpak, both of Osaka, Japan

[21] Appl. No.: 197,214

[22] Filed: Oct. 15, 1980

[30] Foreign Application Priority Data

Oct. 16, 1979 [JP] Japan ..... 54-143171
Aug. 15, 1980 [JP] Japan ..... 55-115654

[51] Int. Cl.[3] ..... G01F 11/04

[52] U.S. Cl. ..... 222/153; 222/181; 222/380

[58] Field of Search ..... 222/181, 185, 207, 321, 222/340, 380, 383, 494, 153; 215/225

[56] References Cited

U.S. PATENT DOCUMENTS

| | | | |
|---|---|---|---|
| 1,187,474 | 6/1916 | Hollingsworth | 222/383 X |
| 2,605,021 | 7/1952 | Churchill et al. | 222/181 X |
| 2,772,817 | 12/1956 | Jauch | 222/207 |
| 2,825,334 | 3/1958 | Kas | 222/85 X |
| 3,160,329 | 12/1964 | Radic et al. | 222/494 X |
| 3,848,776 | 11/1974 | Schieser | 222/181 X |

FOREIGN PATENT DOCUMENTS

| | | |
|---|---|---|
| 2121739 | 11/1972 | Fed. Rep. of Germany . |
| 101580 | 10/1923 | Switzerland . |
| 285438 | 9/1952 | Switzerland . |
| 331376 | 8/1958 | Switzerland . |
| 711630 | 7/1954 | United Kingdom . |

*Primary Examiner*—F. J. Bartuska
*Attorney, Agent, or Firm*—Cushman, Darby & Cushman

[57] ABSTRACT

The wall-mounted dispenser for liquid soap has a separable reservoir with an outlet valve. The dispenser further includes a main body with a second outlet valve. When the reservoir is mounted to the main body, a metering chamber is defined between the two outlet valves. The dispensing function is experienced by pushing in a plunger which temporarily decreases the chamber volume and forces the main body outlet valve to open temporarily, thus dispensing a charge of liquid soap. As the plunger is released, a spring return pushes the plunger out, decreasing pressure in the metering chamber, which is equalized as the first outlet valve temporarily opens, admitting a next charge of liquid soap from the reservoir to the metering chamber. The reservoir is replaced by pushing in a resilient release, but the resilient release is preferably normally provided with a stop which must first be moved out of the way. This is to prevent the user from accidentally disconnecting the reservoir when what is really wanted is a dispensation of soap. Should the reservoir be disconnected, pushing in and releasing the plunger will not result in the first outlet valve to open, because pressure will not be lowered in the metering chamber when the plunger is released.

3 Claims, 21 Drawing Figures

DISPENSER, PARTICULARLY FOR LIQUID SOAP

BACKGROUND OF THE INVENTION

1. Field of the Invention

The present invention relates to dispensers for fluent material, and particularly to the type that are normally wall-mounted and used, e.g. beside sinks, to dispense a quantity of liquid soap at one touch of an actuator by the intended user.

2. Description of the Prior Art

Heretofore, dispensers for supplying liquid soap in a predetermined volume by one touch of an actuator have been widely employed in washrooms, etc. Most of them have been designed such that: the dispenser main body or vessel and a liquid soap reservoir have been integrally constructed and so that a fresh supply of liquid soap has been poured into the reservoir, e.g. from a drum, when the soap supply in the reservoir has been substantially used-up. However, after long usage, solidified soap adheres about the liquid soap reservoir portion of such a dispenser and the pouring inlet-outlet thereof and such adhered soap has not been easily wiped-off from the outside. Thus, these conventional dispensers have provided a difficulty of complete cleaning and also have given an unfavorable aesthetic appearance.

Another type of known dispenser has been designed such that the dispenser main vessel and a liquid soap reservoir have been separately constructed and the liquid soap reservoir has been exchanged when the soap supply in such reservoir has been substantially exhausted or used-up. However, in the prior art devices of this type, the locking means for locking the liquid soap reservoir to the separate dispenser body has been inconvenient.

For releasing such locking condition, a button is normally employed, but a careless pushing of the button has been sufficient to release the coupling of the reservoir and valve seats of the dispenser and to permit the liquid soap to leak at this site and hence provide a drawback that as the dispenser continues to be operated the predetermined volume of the liquid soap is not conveniently supplied and more leakage occurs each time the actuator is pushed.

SUMMARY OF THE INVENTION

The present invention has been provided to overcome such drawbacks in the prior art.

The wall-mounted dispenser for liquid soap has a separable reservoir with an outlet valve. The dispenser further includes a main body with a second outlet valve. When the reservoir is mounted to the main body, a metering chamber is defined between the two outlet valves. The dispensing function is experienced by pushing in a plunger which temporarily decreases the chamber volume and forces the main body outlet valve to open temporarily, thus dispensing a charge of liquid soap. As the plunger is released, a spring return pushes the plunger out, decreasing pressure in the metering chamber, which is equalized as the first outlet valve temporarily opens, admitting a next charge of liquid soap from the reservoir to the metering chamber. The reservoir is replaced by pushing in a resilient release, but the resilient release is preferably normally provided with a stop which must first be moved out of the way. This is to prevent the user from accidentally disconnecting the reservoir when what is really wanted is a dispensation of soap. Should the reservoir be disconnected, pushing in and releasing the plunger will not result in the first outlet valve opening, because pressure will not be lowered in the metering chamber when the plunger is released.

One of the objects of this invention is to provide a soap dispenser of the type designed to have a detachable soap reservoir which can be exchanged for a new one full of liquid soap for further dispensing, thereby providing easy handling and maintenance, and also permitting easy washing and cleaning of the dispenser without need for detaching the dispenser from the wall and the like, causing no delay for obtaining one charge of the liquid soap, nor supplying any excessive amount of liquid soap.

Another object of the present invention is to provide a soap dispenser with a locking means for the releasing button which releases the locking state of the dispenser main body and the liquid soap reservoir wherein said locking means is designed so that a careless pushing of the releasing button does not cause the release of the locking state, release of the locking state being possible only when the locking means is intentionally unlocked so that the soap reservoir may be exchanged.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF THE PRESENTLY PREFERRED EMBODIMENT

Figure 1:
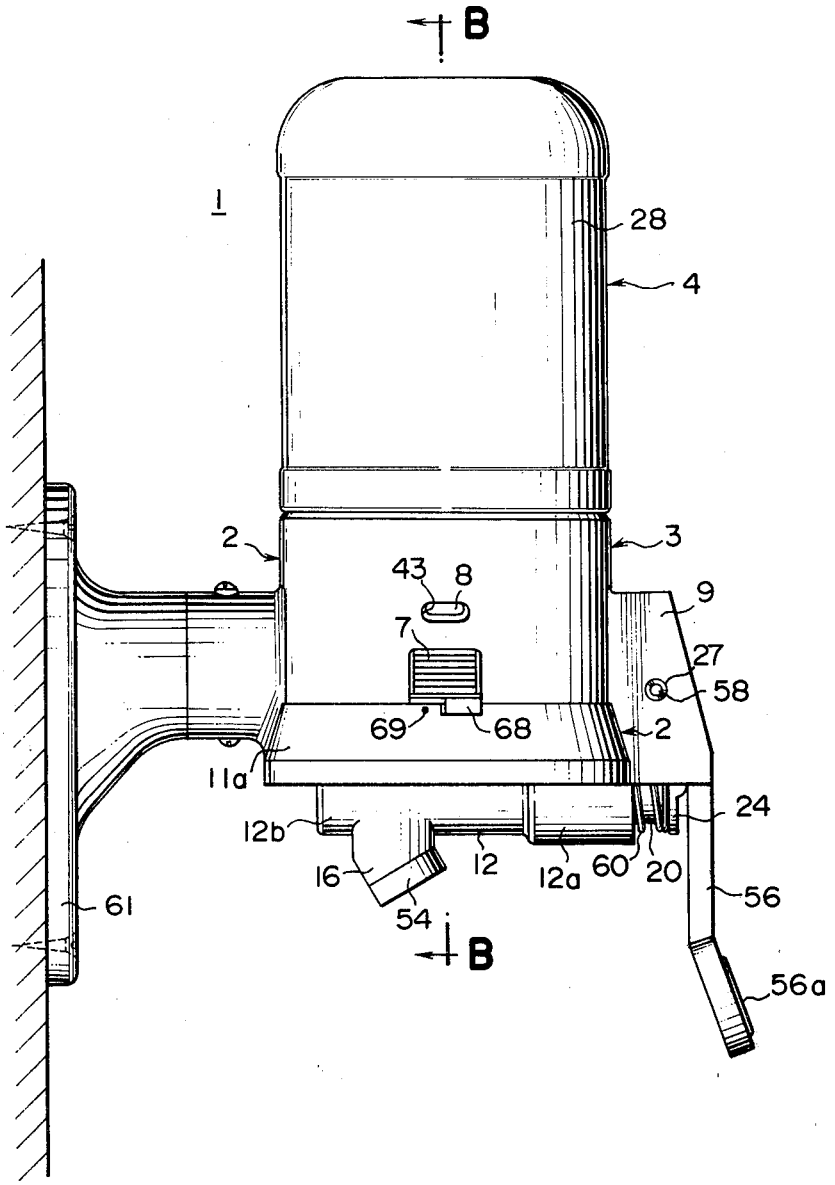
FIG. 1 is a left side elevation view of the dispenser of the invention in an assembled condition and wall-mounted, ready for use.
Figure 2:
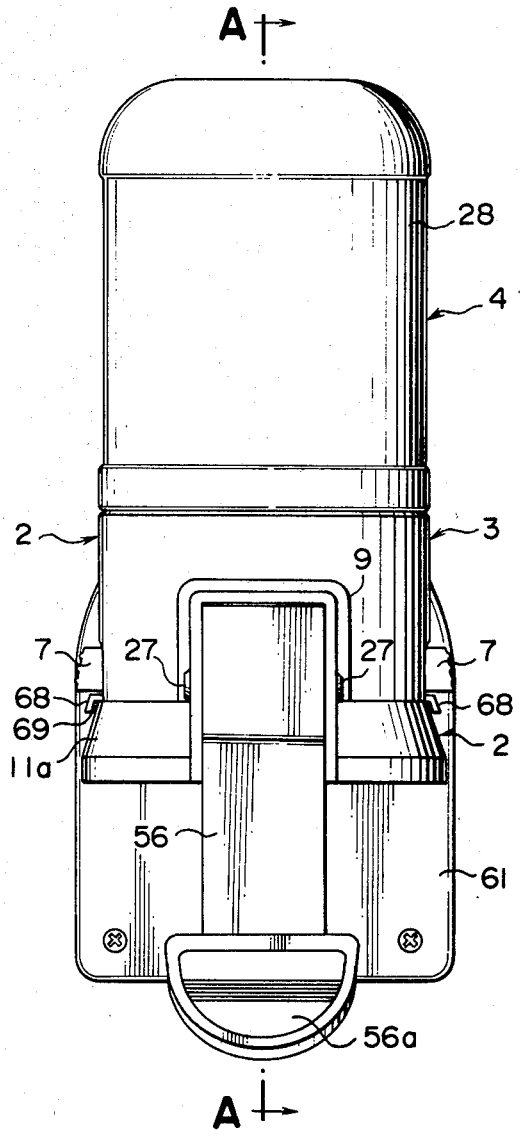
FIG. 2 is a front elevation view thereof.

The dispenser 1 includes an upright open top/closed cylindrical main body 2 that has an open forward end/-closed rear end cylinder 12 formed in the bottom wall thereof. A through hole 14 is formed through the bottom wall of the main body 2 into the chamber defined within the cylinder 12, and this opening 14 is perimetrically spacedly surrounded by a first valve seat, shown having the form of an upwardly opening groove. Below this, and somewhat rearwardly, the cylinder 12 is provided with a tubular boss 16 which projects downwardly and forwardly to provide a housing for a second outlet valve 48. The boss 16 includes an internal longitudinal passage **16*a* in communication with the mtering chamber within the cylinder 12, which passage 16*a* includes a series of two, stepped annular shoulders 19, 18 and a band of internal threading 17**.

Figure 16:
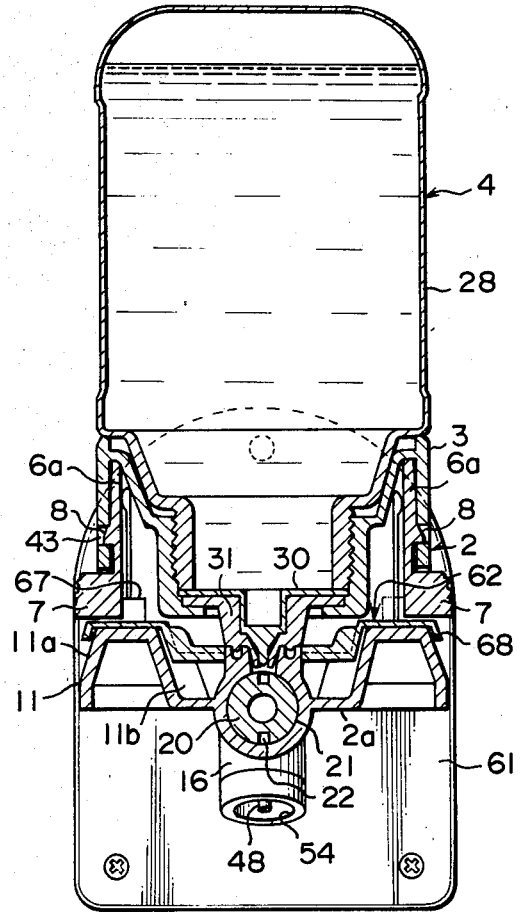
FIG. 16 is a longitudinal vertical sectional view showing the rear half of the whole device shown in FIG. 1.

The main body 2 may be made fully or partly from synthetic resin and is shown including a tubular sidewall 5, in which, at two diametrically-opposed (e.g. left and right side) locations, is provided with U-shaped slots 6 which thus partially separate from the tubular sidewall 5 two tongue-shaped releasing button bodies **6*a* which have resilient shank portions with enlarged, outwardly protruding releasing buttons 7 at their lower ends. Spaced above each button 7, each resilient shank 6*a* is provided with a generally horizontally-elongated, lozenge-shaped protuberance 8 of generally triangular vertical cross-sectional shape. Each protuberance 8 is so located on the respective tongue 6*a* so that when the respective button 7 is pushed in, the respective protuberance 8 is pushed in, albeit to a lesser extent. Preferably, each protuberance 8 has a sloping upper surface and a horizontal lower surface, as shown in FIG. 16**.

At the front of the main body, surrounding the top and part of the sides of the cylinder 12 is a protruding flange 9 of inverted U-shape, providing a supporting frame.

At the inside top front of the supporting frame 9 are provided stop ridges 26, and in the sidewalls above the cylinder 12 are provided hinge pintle bosses 27 for journalling the pivotable actuator 56.

Figure 15:
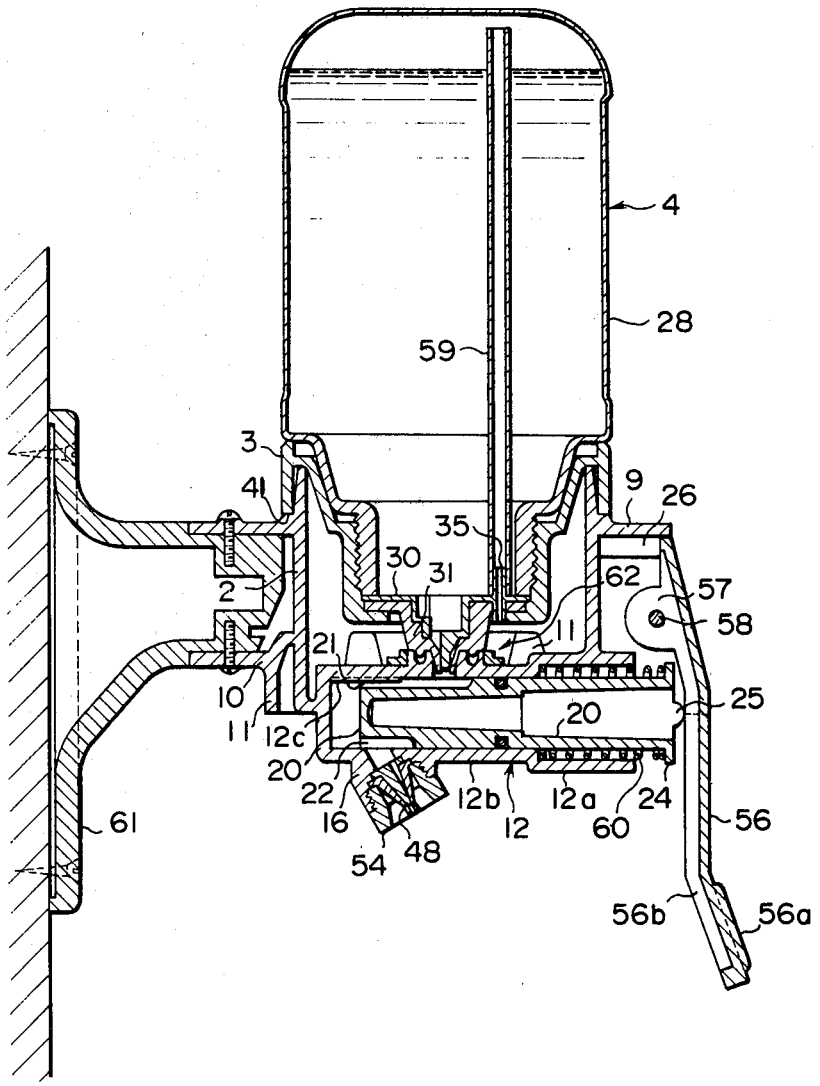
FIG. 15 is a longitudinal vertical sectional view showing the right half of the whole device shown in FIG. 1.

Diametrically opposite the supporting frame 9, the main body 2 sidewall 5 is externally provided with a support bracket boss 10, which is used for removably securing the dispenser to a support bracket 61, which is, in turn, wall mounted. See FIG. 15. Thus, the bracket 61 can be conveniently mounted with the rest of the device not in the way, and once mounted to the wall need not be detached to detach the rest of the dispenser from the wall.

Figure 20:
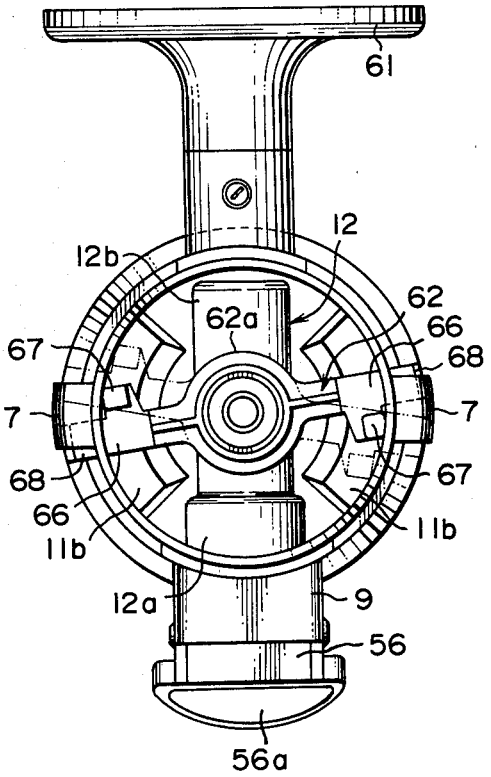
FIG. 20 is a top plan view of the main body as mounted on the wall, the locking position of the stop member being shown in full lines and the unlocking position thereof being shown in phanton lines.

On opposite sides of the cylinder 12, the bottom wall **2*a* of the main body 2 is provided with a structure 11 comprising two respective fan-shaped upward protrusions of generally inverted U-shaped cross-sectional shape. See FIG. 21. Each such protrusion includes an upwardly presented surface 11*b* that is fan-shaped in top plan view (FIG. 20). The bottom wall 11 further includes a flared, frustoconically-curved outer skirt 11*a*, which provides a depending skirt for the main body 2 sidewall 5. The skirt 11*a* extends arcuately from one side of the supporting frame 9 all the way round the sidewall 5 to the other side of the supporting frame 9. See FIGS. 1, 15 and 16**.

The cylinder 12, internally, has a rear portion **12*b* of smaller internal diameter and a forward portion 12*a* of larger internal diameter. At the top near the rear, closed end, the cylinder 12 is internally provided with a longitudinally extending guide rail 12*c*, which is received in a groove 21 in the plunger piston 20. See FIGS. 6, 15, 17 and 18**.

Figure 17:
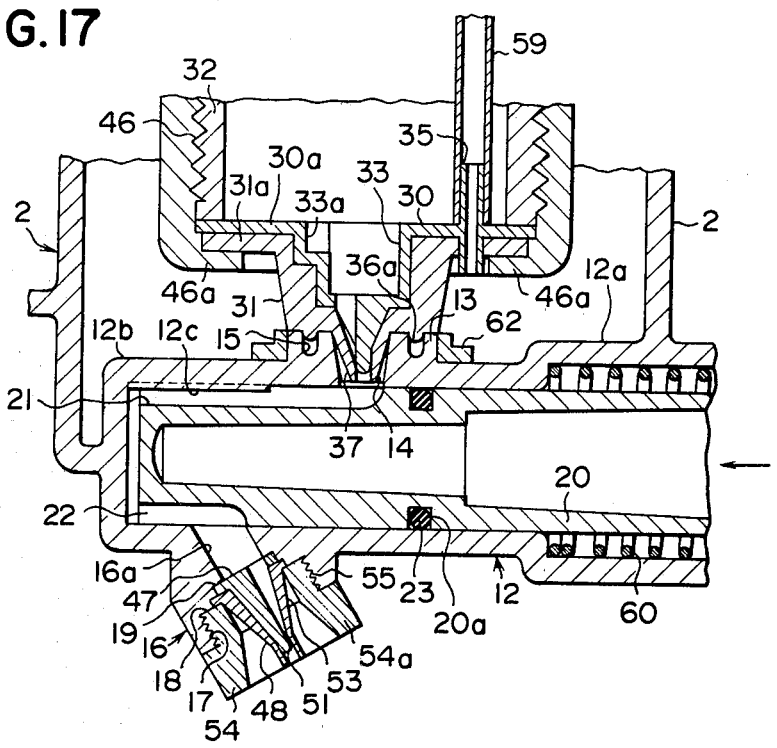
FIG. 17 is a larger-scale fragmentary sectional view showing a portion of what is shown in FIG. 15 in more detail, but with the plunger in a pushed-in state.

The piston 20 is slidably received in the cylinder 12. The piston 20 preferably is a tubular member with a closed rear end and a sidewall provided so as to correspond in diameter to the smaller diameter portion **12*a* of the cylinder bore. Opposite the smaller diameter portion of the cylinder, the piston 20 is formed with two longitudinal grooves which extend all the way to the rear of the piston 20. These are a first groove 21 which runs along the top of the piston sidewall and a second one 22 which runs along the bottom of the piston sidewall. Spaced axially forwardly of the forward extent of the grooves 21, 22, the piston sidewall, also opposite the smaller diameter portion of the cylinder is provided with a cirumferential groove 20*a* in which is received an O-ring 23 for sealing between the piston and cylinder forwardly of the grooves 21, 22. The groove 21 is shown being longer than the groove 22. As shown in FIG. 17, the grooves are preferably long enough so that even when the piston 20 is pushed all the way in, the groove 21 remains in communication with the outlet side of the first outlet valve 37, etc. and the groove 22 remains in communication with the inlet side of the second outlet valve 48**, etc.

At its forward end, the piston is fitted with a ring-shaped flange 24, on which at the nine o'clock and three o'clock positions are provided half moon-shaped flanges 25, the inner faces of which are flush with the inside of the piston 20. The flanges 25 protrude forwards further than the flange 24 does.

Figure 18:
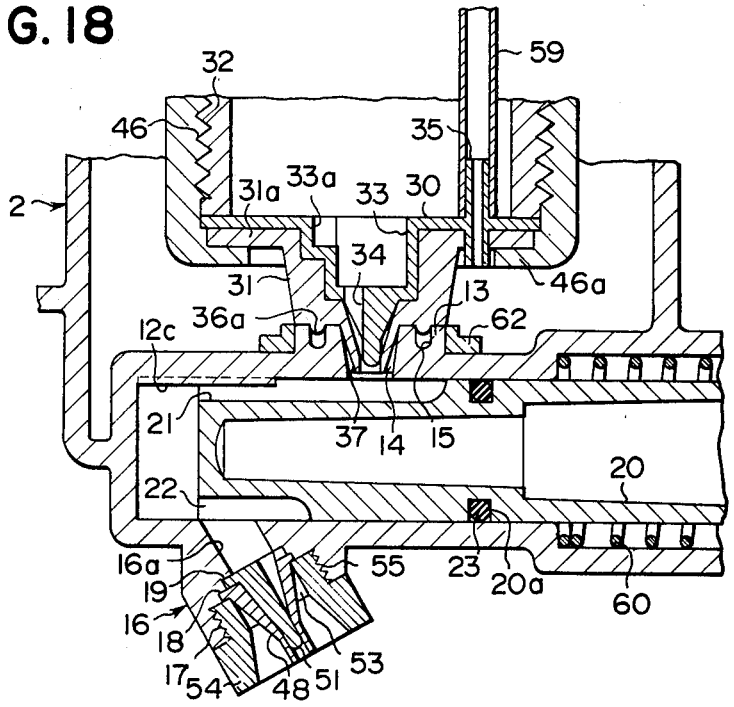
FIG. 18 is a fragmentary sectional view similar to FIG. 17, but with the plunger in a returned state.

A compression coil spring 60 is coaxially provided on the shank of the piston with a forward end against the back of the flange 24 and a rear end against the annular shoulder formed in the cylinder 12 at the point where the larger internal diameter portion **12*a* adjoins the smaller internal diameter portion 12*b*, so that when the piston is pushed in from the FIG. 18 disposition thereof to the FIG. 17 disposition thereof, and released, the spring 60 will push the piston 12 back out to the FIG. 18** disposition thereof.

The lever 56 is narrow enough at the top to fit between the sides of the supporting frame member 9, where it is pivotally secured at 58 to the main body 2. (As shown, the lever 56 is shallowly, broadly U-shaped in transverse cross-sectional shape, so as to have a broad central flange and two rearwardly projecting opposite side flanges **56*b*, which in the upper part of the lever 56 are enlarged at 57 to provide hinge brackets which are pivotally connected with the bosses 27 at 58**.) The lower end region of the lever is angled forwards, i.e. towards the user, and provided with an e.g. semi-circular, enlarged push piece which may be covered with non-slip rubber or the like.

The rear edges of the flanges 56*a* normally bear against the half-moon flanges 25, so that the piston may be pushed in by simply pushing on the push piece 56*a*.

As described above, the first outlet valve seat 13, is partially formed in the bottom wall 2*a* of the main body 2, particularly the opening 14 surrounded by an annular thickened portion having the upwardly opening perimetrically extending groove 14. The opening 14 preferably has a frusto-conically curved sidewall which tapers downwards.

The reservoir 4 for containing the liquid that is to be dispensed comprises a container body 28 having an end wall, a sidewall, a shoulder and a tubular neck. When disconnected from the device 1, the reservoir 4 usually would have the orientation shown in FIG. 5. In use, as shown in FIGS. 1, 2 and 15–18 the reservoir 4 is inverted so as to be oriented neck-downwards/end wall-upwards. The neck is externally threaded at 32. The shoulder includes a series of two, stepped annular, axially-facing flanges 28*a*, 28*b*, with a frusto-conically curved transitional surface portion extending between them.

The reservoir 4 further includes a suction cap 30 comprising a disk-shaped flat flange 30*a*, the outer diameter of which is about equal to that of the end of container body neck, so that the suction cap 30 may be butted against the end of the neck and not protrude radially therebeyond.

Axially centrally, the outer face of the suction cap is provided with a hollow-generally cylindrically shaped protuberance 33 having a half moon-shaped radial projection 33*a* formed at one side. Upon the protuberance 33 is coaxially formed a spike 29, having a frustoconical base portion and a generally round-ended cylindrical tip portion 29*a*. At three equi-angularly spaced sites, axial grooves 34 are formed in the conical base portion of the spike 29.

At a radially intermediate site nearly diametrically opposed to the projection 33*a*, a tubular boss 35 is formed on the flat flange 30*a*. The bore of the boss 35 communicates through the flat flange 30*a*. The boss 35 is, on the inner face of the flat flange 30*a*, fitted with an extension tube 59 which, when the suction cap is fitted to the container body neck, projects within the container body to near the container end wall.

The first valve comprises a body 31, e.g. made of soft synthetic rubber or the like, having a resilient quality. It includes a flat circular disk portion 31*a* of the same diameter as the disk 30*a*, and having an eccentrically-located opening 38, positioned to fit over the tubular boss 35 when the flanges 30*a* and 31*a* are brought into coaxial adjacency. Axially centrally, the disk 31*a* is provided with a frusto-conical boss 36, tipped with a smaller frusto-conical boss 37, to provide an annular, axially facing shoulder adapted to annularly, sealingly project, in an intermediate ring-shaped region 36*a*, into the valve seat annular groove 15. The boss 37 is open at the outer end at 37*a*. The reverse side of the valve 31 from the projection 36, 37 is recessed, complementary to the shape of the parts 33, 33*a*, 29, 29*a* of the suction cap 30, so as to receive such parts as the two disks 30*a*, 30*a* are brought together.

Figure 4:
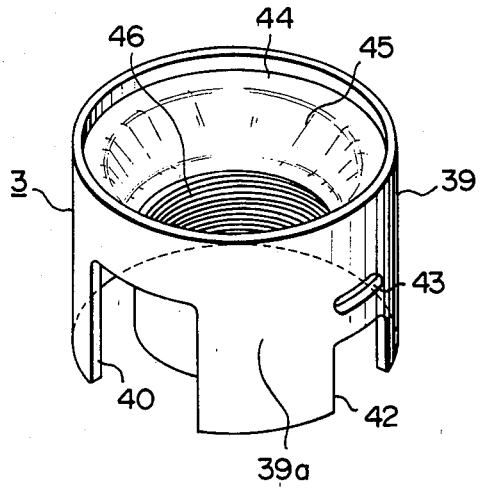
FIG. 4 is a perspective view of the cap for the reservoir container body.

The parts 30, 31 are held together on the end of the container body 28, by screwing on the cap 3, that is shown by itself in FIG. 4.

The cap 3 includes a cylindrical sidewall, which is internally threaded at 46 and a ring-shaped end wall 46*a* having a large central opening through which the projections on the suction cap 30 and first valve 31 protrude. The cap is secured on the container body by threading the threads 46 onto the threads 32. Above the threading 46 (FIG. 4 orientation) the sidewall flares to provide a downwardly tapering surface 45, then projects radially outwards to provide an annular, axially facing flange, and then doubles back downwards to provide an outer cylindrical skirt 39. The skirt 39, at two diametrically opposed positions is provided with generally squared-off notches 40, 41 opening through the lower edge of the skirt 39. These are sized, shaped and located to fit over the supporting frame 9 and the supporting member 10, respectively.

Angularly between the notches 40, 41, the lower edge of the skirt 39 is provided with two more squared-off notches 42, sized, shaped and positioned to fit over the releasing buttons 7.

Spaced above the notch 42, the skirt 39 is provided on each side with an angularly elongated oval slot 43, sized, shaped and positioned to allow the corresponding lozenge-shaped protuberance 8 to protrude outwards therethrough.

Figure 5:
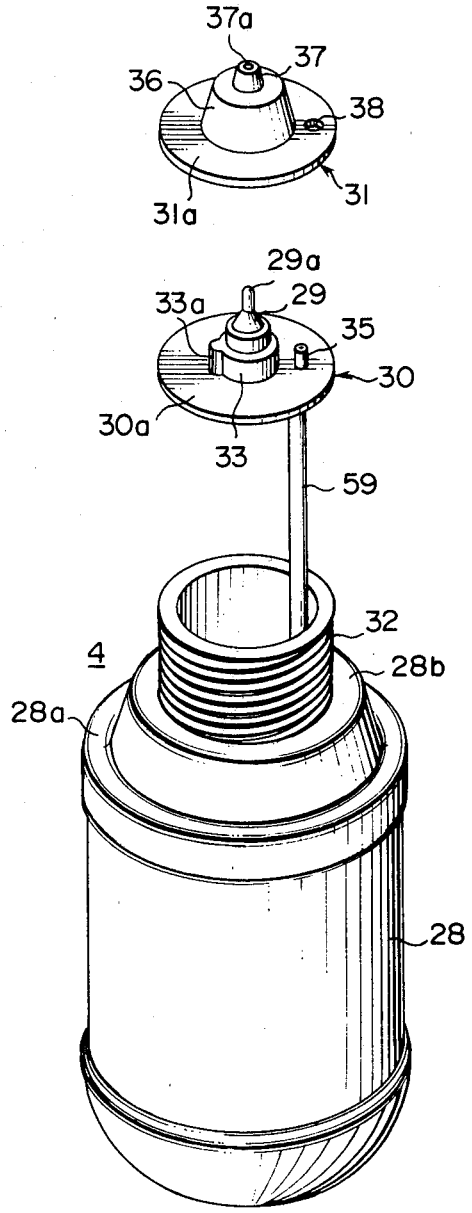
FIG. 5 is an exploded perspective view of the reservoir container body, the suction cap therefor, and exploaded from the rest, the body of the first outlet valve, all shown inverted from their orientation while in use.
Figure 6:
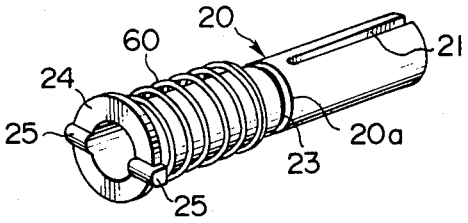
FIG. 6 is a perspective view of the spring-returned plunger of the main body.
Figure 7:
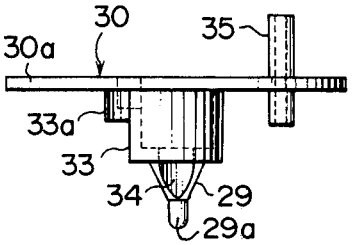
FIG. 7 is a side elevation view of the suction cap.
Figure 8:
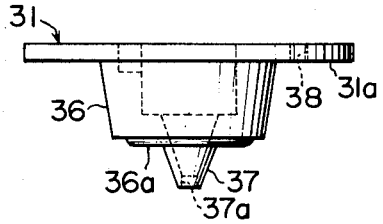
FIG. 8 is a side elevation view of the body of the first outlet valve.
Figure 9:
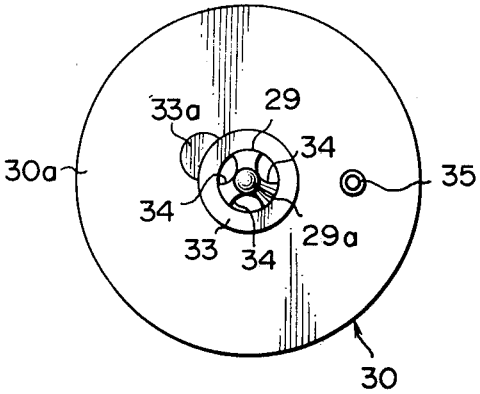
FIG. 9 is a bottom plan view of the suction cap.
Figure 10:
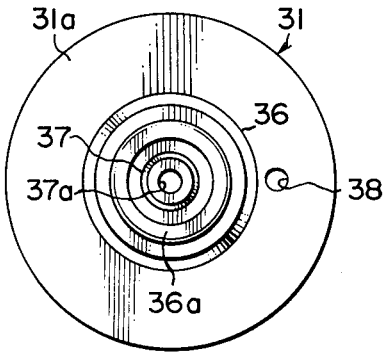
FIG. 10 is a bottom plan view of the body of the first outlet valve.

The parts 31, 30, 59 and 4 are assembled together from their FIG. 5 positions and secured together by the threading on the cap 3 until the surface 45 abuts the corresponding surface of the container and the cap end wall 46*a* squeezes the flanges 30*a*, 31*a* against the end of the container neck.

Figure 3:
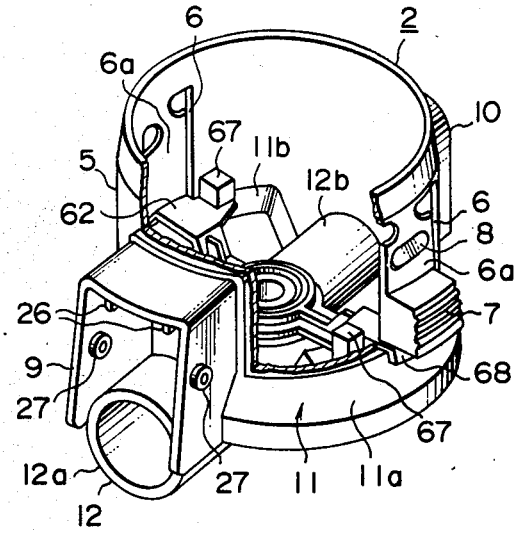
FIG. 3 is a perspective view, partially cut-away and sectioned, of the main body of the dispenser, with the actuator and plunger removed.

The assembled container is secured to the dispenser main body by inverting the assembled container from its FIG. 5 disposition and lowering its lower end into the well shown in FIG. 3, until the notch 40 receives the supporting frame 9, the notch 41 receives the supporting member 10, the notches 42 receive the releasing buttons 7 and the protuberances 8 snap into the slots 43. This acts also pulls the first valve 31 tightly against the seat 13 at 36*a*, 15.

Centrally, the well of the main body 2 is provided with an upwardly directed boss, comprising the aforementioned valve seat 13.

Figure 19:
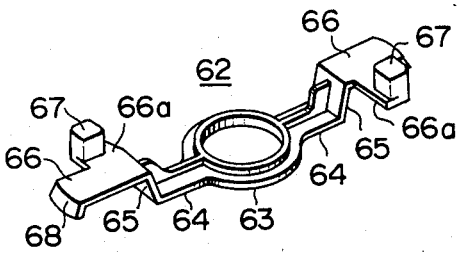
FIG. 19 is a perspective view of the stop member used to prevent inadvertent unlatching of the reservoir of the dispenser from the main body thereof.

The present invention provides a stop member for preventing accidental disconnection of the reservoir 4 from the main body 2. The stop member 62 is shown by itself in FIG. 19. It comprises a fitting having a central ring-shaped flange portion 63 which fits around the valve seat 31 and two diametrically-oppositely directed arms 64 which slant upwards at 65, then have a horizontal flange portion at 66, and an outer, downwardly flaring lip at 68. In use, the flanges 66 rest on the surfaces 11*b* in the well of the main body as shown in FIG. 20, and the lips 68 protrude out through and down from the same slots 42 as the releasing buttons 7. However, the flanges 66 are somewhat narrower than the slots 42, so that the fixture 62 may be moved angularly between two extremes.

In one angular extreme of the stop member fixture 62, (shown in full lines in FIG. 20), the lugs 67 back up the resilient pieces 6*a*, preventing the buttons 7 from being pushed-in sufficiently to release the protuberances 8 from the slots 43. In the other angular extreme, (shown in dashed lines in FIG. 20), the lugs 67 are angularly clear of the resilient pieces, so that the buttons 7 may be pushed in to release the reservoir from the main body. In use, the fixture 62 is kept in its full line latching condition so that a user cannot accidentally disconnect the reservoir from the main body by pressing in the releasing buttons 7. The only time the fixture 62 is brought to the dashed line position is to permit intentional disassembly and replacement or refilling of the reservoir.

Figure 21:
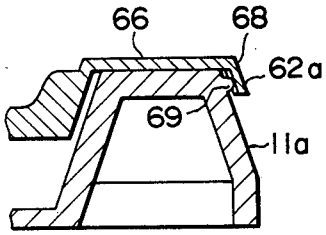
FIG. 21 is a larger scale fragmentary longitudinal sectional view showing a portion of what is shown in FIG. 16.

As shown in FIG. 21, the skirt 11*a* on the main body 2 is provided with an external bead 69 which backs-up the inner sides of the tabs 62*a* of the bent portion 68 in order to keep the fixture 62 in either position in which it is intentionally placed.

Figure 11:
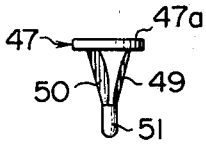
FIG. 11 is a side elevation view of the closure member of the second outlet valve.
Figure 12:
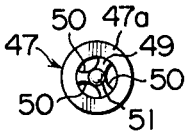
FIG. 12 is a bottom plan view of the closure member of the second outlet valve.
Figure 13:
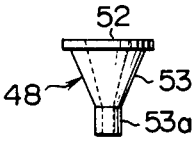
FIG. 13 is a side elevation view of the body of the second outlet valve.
Figure 14:
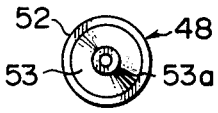
FIG. 14 is a bottom plan view of the body of the second outlet valve.

The device shown is completed by the structure of the second valve, parts of which are shown by themselves in FIGS. 11–14. In FIGS. 11 and 12 is shown the valve body 47, having disk 47*a*, frusto-conical part 49, grooves 50 and central projection portions 51 comparing to the structures 30*a*, 29, 29*a* of the first valve. In FIGS. 13 and 14 is shown the surrounding portion of the second valve 48, comprising a flange 52, a frusto-conical tubular portion 53 and an open outer end cylindrical portion 53*a*. This part compares to the part 31 shown in FIG. 5. The parts 47 and 48 are assembled to one another and mounted in the second valve seat 16 as shown i.a. in FIG. 17, against the stepped shoulders 19, 18 shown therein.

These members are held in place by an annular cap 54, which compares with the cap 3. The cap 54 is externally threaded at 55 to screw into the threads 17. The outer annular skirt portion 54*a* of the cap 54 is internally flared towards the outer lower end.

Each valve body is ported through the grooves in its tapered portion, e.g. at 34, 50, but the tapering tubular flap which surrounds each valve body normally resiliently engages the projection 29*a* or 53*a* to prevent flow through that valve. In order for there to be flow through the respective valve, it is necessary either to relatively lower the pressure on the downstream side of the respective valve or to raise the pressure on the upstream side of that valve.

In use, one obtains a quantum of liquid, e.g. liquid soap from the dispenser by pushing-in on the handle 56*a*. This pushes in the piston 20, compressing the spring 60. As the piston 20 is pushed in, the volume of space in the chamber behind the piston is decreased, which increases the pressure within the chamber sufficiently to cause the thin resilient portion of the second valve at 53*a* to move radially outwards temporarily. This permits the quantum of liquid in the chamber to flow out between the bore of the portion 53*a* and the protuberance 51, through the channels 50. At this time the first valve 31 remains closed. As the pressure equalizes, the resilient portion 53*a* recovers and the second valve closes, having dispensed a quantum of the liquid.

As the user lets go of the dispenser lever button 56*a*, the spring 60 recovers, pushing out the piston 20. This enlarges the volume of the chamber thus lowering the pressure on the downstream side of the valve 31. Accordingly, the annular flap 37 temporarily resiliently distends away from the central protuberance 29*a*, permitting a next quantum of liquid to flow through the channels 30 of the first valve into the dispensing chamber, ready for the next user's push on the operating lever push piece 56*a*. As the pressure in the dispensing chamber equalizes, the resilient part 37 recovers its smaller diameter and the first valve closes. Since both the valves 31 and 48 are one-way valves, the second valve 48 remains closed as the dispensing chamber is refilling through the first valve 31. The vent tube 59 which extends up to near the top of the container 28, i.e. to above the liquid level therein permits the head space above the liquid to recover atmospheric pressure, since it lies outside the main body/reservoir seal provided at 13, 36*a*.

Although use of the stop member 62 is preferred, it and its function may be simply omitted, yet the other advantages of the device of the present invention may be enjoyed. If someone should push in the operating lever 56 after the releasing buttons 7 have been pushed in, because the sealing connection at 36*a*, 13 will have been disrupted, upon releasing the lever 56, the pressure in the dispensing chamber at 21, 22, 16*a* within the cylinder 12 ahead of the piston 20 will not lower, so no more liquid will come out of the reservoir 4.

It should now be apparent that the dispenser, particularly for liquid soap as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A dispenser for liquid such as liquid soap, comprising:

means providing a reservoir disconnectably connected to a main body;

said reservoir including a container having a first normally-closed, pressure-operated one-way outlet valve and securement means by which said reservoir may be disconnectably connected to the main body;

said main body including an upwardly opening well for receiving a latter portion of said reservoir; a cylinder having a inner end in communication with said well; a piston slidably mounted in said cylinder and being provided with resilient means for pushing said piston back out when said piston is pushed in; releasable securement means on said main body for cooperation with said securement means on said reservoir to disconnectably connect the reservoir to the main body; means defining a dispensing chamber in said cylinder inwardly of said piston; means defining a portion from said well to said chamber; said one-way outlet valve being disposed to open through said opening into said chamber and said reservoir being sealed to said cylinder perimetrically of said opening when said reservoir is connected to said main body; a second normally-closed, pressure-operated one-way outlet valve from said cylinder, having an upstream side in communication with said chamber; and a vent tube for said reservoir extending from the headspace therein, at atmosphere, so that as said piston is pushed-in, the pressure in said dispensing chamber is raised, causing only said second valve to temporarily open and to dispense a quantum of liquid from said dispensing chamber and as said piston is released and pushed back out the pressure in said dispensing chamber is lowered, causing only said first valve to temporarily open and to replenish said dispensing chamber with a quantum of liquid from said reservoir, said securement means for disconnectably connecting the reservoir to the main body comprising a plurality of lateral protuberances on the main body which fit into corresponding laterally opening recesses provided on cantilevered resilient tabs on the main body; these tabs having externally presented releasing buttons which may be pushed inwards to flex the tabs inwards and thus free the securement means; and a locking means for preventing accidental disconnection of the reservoir from the main body, said locking means comprising a fixture normally disposed within the main body and mounted therein for limited angular movement; said fixture having tab means protruding out through the main body for external access; said fixture including stop means which in one angular position of said fixture abuttingly back-up said releasing buttons and prevent said releasing buttons from being pushed in sufficiently to free the aforesaid lateral protuberances on the reservoir from the aforesaid laterally opening recesses on the main body and which in another angular position of said fixture are out from behind said releasing buttons so that said releasing buttons may be pushed in sufficiently to disconnect the reservoir from the main body.

2. The dispenser of claim 1, wherein:

the piston is grooved to provide communication between the outlet side of the first valve and the dispensing chamber, and between the dispensing chamber and the inlet side of the second valve.

3. The dispenser of claim 1, wherein;

each of the valves comprises a central protrusion normally resiliently sealingly engaged by a tapered tubular resilient flap.

* * * * *